US006895765B2

(12) United States Patent
Bonaquist et al.

(10) Patent No.: US 6,895,765 B2
(45) Date of Patent: May 24, 2005

(54) METHOD FOR PROVIDING COOLING TO SUPERCONDUCTING CABLE

(75) Inventors: Dante Patrick Bonaquist, Grand Island, NY (US); Bryce Mark Rampersad, Williamsville, NY (US); John Henri Royal, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/768,079

(22) Filed: Feb. 2, 2004

(65) Prior Publication Data

US 2005/0050905 A1 Mar. 10, 2005

Related U.S. Application Data

(62) Division of application No. 10/396,353, filed on Mar. 26, 2003, now Pat. No. 6,732,536.

(51) Int. Cl.[7] ..... F17C 9/02; F23D 23/12
(52) U.S. Cl. ..... 62/50.5; 62/259.2; 62/48.1
(58) Field of Search ..... 62/50.5, 259.2, 62/48.1, 48.3

(56) References Cited

U.S. PATENT DOCUMENTS

| | | | | |
|---|---|---|---|---|
| 3,354,662 | A * | 11/1967 | Daunt | 62/601 |
| 3,882,687 | A | 5/1975 | Asztalos et al. | 62/64 |
| 4,175,395 | A * | 11/1979 | Prost et al. | 62/50.2 |
| 4,510,760 | A * | 4/1985 | Wieland | 62/49.2 |
| 4,561,258 | A | 12/1985 | Brodbeck et al. | 62/49 |
| 4,768,356 | A | 9/1988 | Volker | 62/514 |
| 5,156,006 | A * | 10/1992 | Broderdorf et al. | 62/46.1 |
| 5,402,649 | A | 4/1995 | Glasser | 62/54.1 |
| 6,164,078 | A | 12/2000 | Lak et al. | 62/47.1 |
| 6,354,087 | B1 * | 3/2002 | Nakahara et al. | 62/6 |
| 6,477,847 | B1 | 11/2002 | Bonaquist et al. | 62/99 |
| 6,553,773 | B2 * | 4/2003 | Laskaris | 62/64 |
| 2002/0134533 | A1 | 9/2002 | Bechis et al. | 165/104.19 |

OTHER PUBLICATIONS

Bechis et al, "Cryogenic Refrigeration for HTS Power Cables", Proceedings of the Eighteenth International Cryogenic Engineering Conference, India (2000).

Steve et al., "High Temperature Superconducting Cable Field Demonstration at Detroit Edison", Physica C 354 (2001) pp 49-54.

Saji et al., "Design of Oil-Free Simple Turbo Type 65K/6KW Helium and Neon Mixture Gas Refrigerator for High Temperature Superconducting Power Cable Cooling", Proceedings of the Cyogenic Engineering Conference, vol. 47 (2002) pp 893-900.

* cited by examiner

*Primary Examiner*—William C. Doerrler
(74) *Attorney, Agent, or Firm*—Stanley Ktorides

(57) ABSTRACT

A method for providing cooling to superconducting cable wherein pressurized liquid cryogen is passed into a vacuum vessel, which is maintained at a lower pressure by a vacuum pump, and a portion of the liquid cryogen is flashed to produce cooled liquid cryogen. The evacuating energy combined with the pressurized liquid produces a pressure gradient which serves to provide a continuous supply of cooled liquid cryogen for providing cooling to the superconducting cable.

4 Claims, 2 Drawing Sheets

METHOD FOR PROVIDING COOLING TO SUPERCONDUCTING CABLE

This is a Division U.S. Application(s) Ser. No. 10/396,353, Filing Date: Mar. 26, 2003 now U.S. Pat. No. 6,732,536.

TECHNICAL FIELD

This invention relates generally to the provision of cooling or refrigeration and, more particularly, to the provision of cooling or refrigeration to superconducting cable.

BACKGROUND ART

Superconductivity is the phenomenon wherein certain metals, alloys and compounds at very low temperatures lose electrical resistance so that they have infinite electrical conductivity.

It is important in the use of superconducting cable to transmit electricity, that the cooling, i.e. refrigeration, provided to the superconducting cable not undergo interruption lest the cable lose its ability to superconduct and the electrical transmission be compromised. While systems which can provide the requisite refrigeration to superconducting cable are known, such systems, such as closed loop turbo mechanical refrigeration systems, are costly, complicated and subject to breakdown, necessitating the use of back up systems to ensure uninterrupted cooling of the superconducting cable.

Accordingly, it is an object of this invention to provide a reliable method for providing cooling to superconducting cable which can be used as the primary or a back up means for providing cooling to superconducting cable.

SUMMARY OF THE INVENTION

The above and other objects, which will become apparent to those skilled in the art upon a reading of this disclosure, are attained by the present invention, one aspect of which is:

A method for providing cooling to superconducting cable comprising:

(A) passing liquid cryogen from a storage vessel to a vacuum vessel, and flashing a portion of the liquid cryogen into the vacuum vessel to produce vapor and cooled liquid cryogen within the vacuum vessel;

(B) pumping vapor out from the vacuum vessel; and (C) passing cooled liquid cryogen from the vacuum vessel to superconducting cable and providing cooling from the cooled liquid cryogen to the superconducting cable.

Another aspect of the invention is:

A method for providing cooling to superconducting cable comprising:

(A) passing liquid cryogen from a storage vessel to a vacuum vessel, and flashing a portion of the liquid cryogen into the vacuum vessel to produce vapor and cooled liquid cryogen within the vacuum vessel;

(B) pumping vapor out from the vacuum vessel; and (C) cooling refrigerant fluid by indirect heat exchange with the cooled liquid cryogen to produce cooled refrigerant fluid, passing the cooled refrigerant fluid to superconducting cable, and providing cooling from the cooled refrigerant fluid to the superconducting cable.

As used herein the term "cryogenic temperature" means a temperature at or below 120K.

As used herein the term "superconducting cable" means cable made of material that loses all of its resistance to the conduction of an electrical current once the material attains some cryogenic temperature.

As used herein the term "refrigeration" means the capability to reject heat from a subambient temperature entity.

As used herein the term "indirect heat exchange" means the bringing of entities into heat exchange relation without any physical contact or intermixing of the entities with each other.

As used herein the term "direct heat exchange" means the transfer of refrigeration through contact of cooling and heating entities.

As used herein the term "vacuum vessel" means a vessel which has an internal pressure less than the pressure of liquid cryogen passed into the vacuum vessel from a storage vessel.

As used herein the term "vacuum pump" means a compressor used to move gas from subatmospheric pressure to atmospheric pressure.

As used herein the term "flashing" means the vaporization of a portion of liquid wherein the portion of liquid vaporized absorbs latent heat of vaporization from its surroundings and therefore cools its surroundings. In this case, the remaining liquid not vaporized is cooled. Lowering the vapor pressure of the liquid induces flashing.

DETAILED DESCRIPTION

In general, the invention comprises the use of a lower pressure vessel into-which liquid cryogen is flashed to produce cooled liquid cryogen which is then used to provide cooling to superconducting cable. The invention provides high reliability cooling to the superconducting cable and is especially useful as back up to a main refrigeration system for the superconducting cable.

Figure 1:
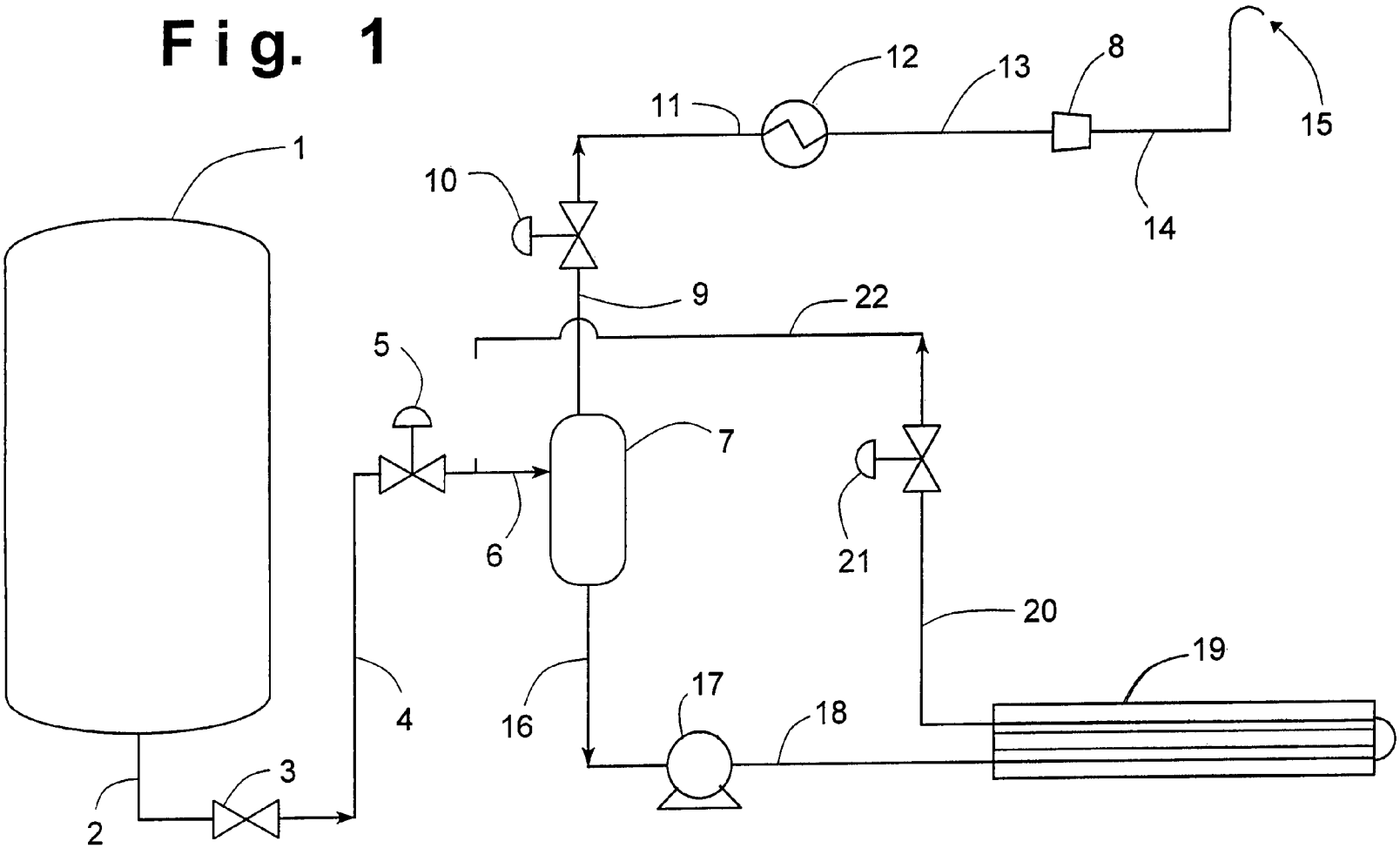
FIG. 1 is a schematic representation of one preferred embodiment of the invention wherein cooled liquid from the vacuum vessel is used to provide cooling to the superconducting cable.

The invention will be described in greater detail with reference to the Drawings. Referring now to FIG. 1, liquid cryogen is stored in liquid cryogen storage vessel 1 at a pressure generally within the range of from 15 to 80 pounds per square inch absolute (psia). The preferred liquid cryogen for use in the practice of this invention is liquid nitrogen.

The liquid cryogen is withdrawn from storage vessel 1 in line 2, passed through valve 3 and in line 4 passed to valve 5 which serves to control the rate at which the cryogen is passed into the vacuum vessel. From valve 5 the liquid cryogen is passed in line 6 to vacuum vessel 7. Vacuum vessel 7 is operating at a pressure, i.e. has an internal pressure, which is less than the pressure of storage vessel 1. Generally the operating pressure of vacuum vessel 7 at least 1 psi less than that of storage vessel 1 and typically will be from 1 to 80 psi less than that of storage vessel 1. Generally the operating pressure of vacuum vessel 7 will be within the range of from 1 to 3 psia.

Because of the low pressure within vacuum vessel 7, as the liquid cryogen is passed in line 6 into vacuum vessel 7, a portion of the incoming liquid cryogen is flashed to vapor leaving the remaining liquid cryogen in a cooled condition. The cooled liquid cryogen settles in a lower portion of vacuum vessel 7 while the vapor occupies an upper portion of vacuum vessel 7. Saturated liquid from the bulk storage tank is introduced into the vacuum vessel initially at the saturation properties of the bulk tank. The normal saturation temperature of the bulk tank is higher than the saturation temperature in the vacuum vessel due to the lowered vapor pressure. This imbalance causes a portion of the liquid to vaporize immediately upon introduction into the vacuum vessel such that a saturated condition can be reestablished. The vaporized liquid provides cooling to the remaining liquid. This occurs because the portion of liquid vaporized absorbs latent heat of vaporization from its surroundings. The cooled remaining liquid is then able to attain its lowered saturation temperature that corresponds to the vapor pressure in the vacuum vessel. Liquid will continue to vaporize until the remaining liquid attains its lowered saturation temperature.

In order to maintain the internal or operating pressure of vacuum vessel 7 at the requisite lower pressure, the vapor is pumped out of the vacuum vessel. In the embodiment of the invention illustrated in FIG. 1, the vapor is pumped out of vacuum vessel 7 by operation of vacuum pump 8. Vapor is withdrawn from vacuum vessel 7 in line or stream 9, passed through valve 10 and in line 11 passed to electric heater 12. A heater is used here to raise the temperature of the vaporized cryogen to a suitable level for the inlet of the vacuum pump. An electric heater is preferred because it provides a lower pressure drop over other types of heaters such as an atmospheric superheater. The vented vaporized cryogen still has refrigeration value and it may be used for other required cooling duty, in which case a smaller heater or no heater will be required. From electric heater 12 the vapor passes in line 13 to vacuum pump 8 and from there in line 14 is passed to vent 15 and released to the atmosphere.

Cooled liquid cryogen is withdrawn from the lower portion, preferably the bottom, of vacuum vessel 7 in line or stream 16, passed to cryogenic pump 17, and from there in line 18 is passed to superconducting cable 19. The cooled liquid is warmed by either direct or indirect heat exchange with the superconducting cable thereby providing cooling, i.e. refrigeration, to the superconducting cable so as to maintain the superconducting cable at the requisite cryogenic temperature.

The liquid cryogen is withdrawn from superconducting cable segment 19 in line 20. The liquid cryogen in line or stream 20 is generally and preferably still in a liquid state. The cooled liquid cryogen is then passed through valve 21 and then in line 22 is combined with the cooled liquid cryogen in line 6 for passage into vacuum vessel 7 for flashing and the further generation of cooled liquid cryogen.

Figure 2:
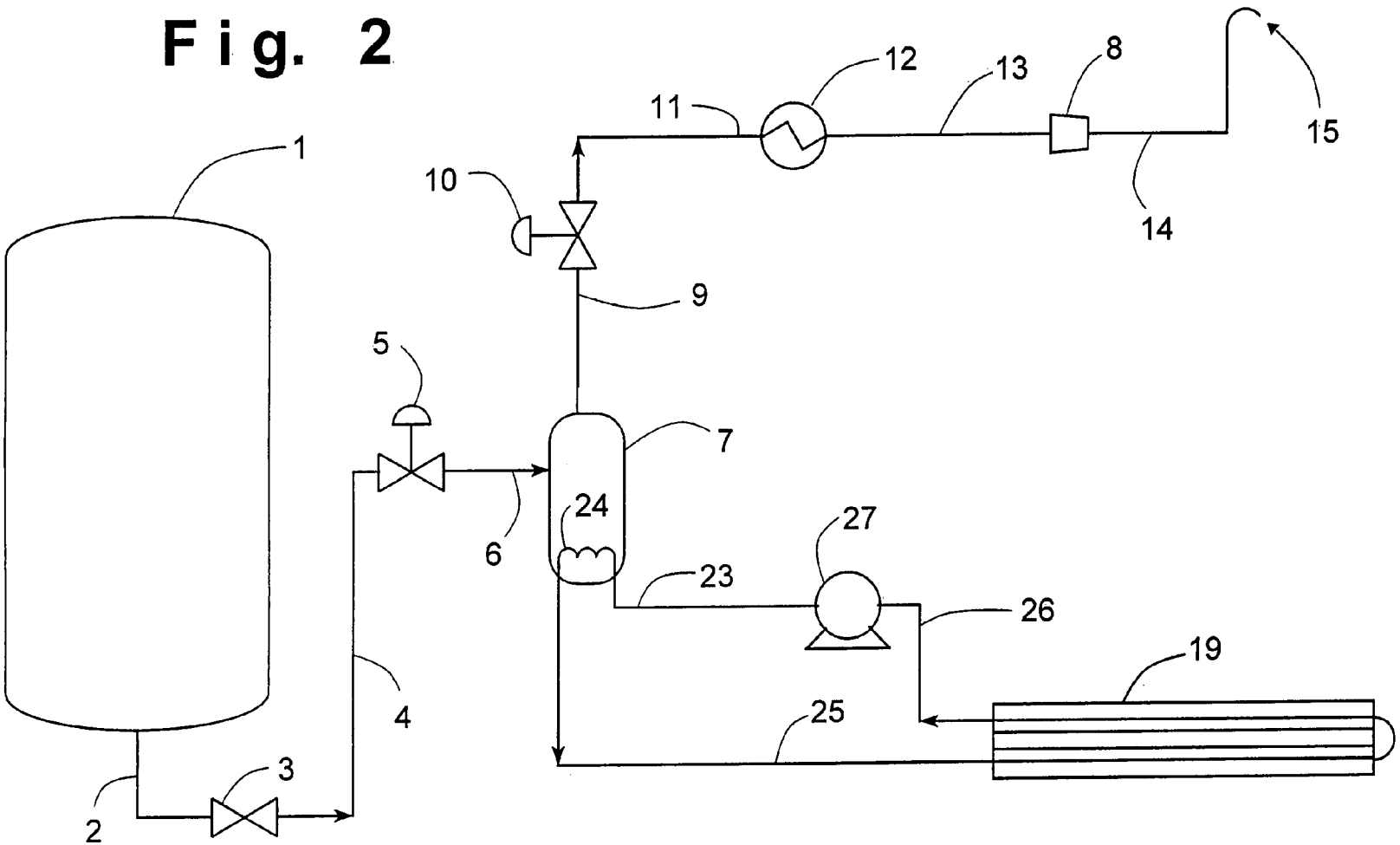
FIG. 2 is a schematic representation of another preferred embodiment of the invention wherein cooled liquid provides cooling to recirculating refrigerant fluid which then provides cooling to the superconducting cable.

FIG. 2 illustrates another embodiment of the invention wherein the cooled liquid cryogen is used to cool recirculating refrigerant fluid which is then employed to provide the cooling to the superconducting cable. The numerals of FIG. 2 are the same as those of FIG. 1 for the common elements, and these common elements will not be described again in detail.

Referring now to FIG. 2, refrigerant fluid in line or stream 23 is passed through heat exchanger 24 wherein it is cooled by indirect heat exchange with cooled liquid cryogen which has been produced as a result of the flashing of the liquid cryogen into vacuum vessel 7. Preferably, as illustrated in FIG. 2, heat exchanger 24, and the heat exchange between the refrigerant fluid and the cooled liquid cryogen, is located within vacuum vessel 7. The preferred refrigerant fluid for use in the practice of this invention is nitrogen, which will always be in a liquid state.

The cooled refrigerant fluid is withdrawn from heat exchanger 24 and passed in line 25 to superconducting cable 19 wherein it provides cooling or refrigeration to the superconducting cable in a manner similar to that previously described with reference to FIG. 1. The warmed refrigerant fluid is withdrawn from the superconducting cable segment in line 26 and passed through cryogenic pump 27, emerging therefrom in line 23 for recirculation back to heat exchanger 24.

Although the invention has been described in detail with reference to certain preferred embodiments, those skilled in the art will recognize that there are other embodiments of the invention within the spirit and the scope of the claims.

What is claimed is:

1. A method for providing cooling to superconducting cable comprising:

(A) passing saturated liquid cryogen from a storage vessel to a vacuum vessel, and flashing a portion of the saturated liquid cryogen into the vacuum vessel to produce vapor and cooled saturated liquid cryogen within the vacuum vessel;

(B) pumping vapor out from the vacuum vessel; and (C) cooling refrigerant fluid by indirect heat exchange with the cooled saturated liquid cryogen to produce cooled refrigerant fluid, passing the cooled refrigerant fluid to superconducting cable, and providing cooling from the cooled refrigerant fluid to the superconducting cable.

2. The method of claim 1 wherein the liquid cryogen comprises liquid nitrogen.

3. The method of claim 1 wherein the pressure of the vacuum vessel is at least 1 pound per square inch less than the pressure of the storage vessel.

4. The method of claim 1 wherein the vapor pumped out from the vacuum vessel is heated prior to pumping and then released to the atmosphere.

* * * * *